US008336801B2

(12) United States Patent
Bobren et al.

(10) Patent No.: US 8,336,801 B2
(45) Date of Patent: Dec. 25, 2012

(54) ANTI-ROTATION SYSTEM FOR STRAP DISPENSER OUTER FLANGE

(75) Inventors: Allan J. Bobren, Streamwood, IL (US); Dustin D. Elliott, Prospect Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 258 days.

(21) Appl. No.: 12/778,404

(22) Filed: May 12, 2010

(65) Prior Publication Data

US 2010/0308150 A1 Dec. 9, 2010

Related U.S. Application Data

(60) Provisional application No. 61/185,085, filed on Jun. 8, 2009.

(51) Int. Cl.
*B65H 23/06* (2006.01)

(52) U.S. Cl. ..... 242/423.1; 242/608.5; 242/609.3; 242/129.8

(58) Field of Classification Search ..... 242/423, 242/423.1, 608.4–608.5, 609.3, 129.8, 156
See application file for complete search history.

(56) References Cited

U.S. PATENT DOCUMENTS 2,580,749 A * 1/1952 Fischer ..... 242/597.2
2,654,550 A * 10/1953 Winkler ..... 242/578.2
3,171,610 A * 3/1965 Hoch ..... 242/575.2
3,907,229 A * 9/1975 Iannucci et al. ..... 242/129.8
6,655,117 B2 * 12/2003 Hoshino ..... 53/589
6,820,402 B1 11/2004 Haberstroh et al.
2004/0200922 A1 10/2004 Nakamura

FOREIGN PATENT DOCUMENTS

EP 1426316 6/2004

OTHER PUBLICATIONS

International Search Report for PCT/US2010/035773, dated Oct. 4, 2010.

* cited by examiner

*Primary Examiner* — Sang Kim
(74) *Attorney, Agent, or Firm* — Levenfeld Pearlstein, LLC

(57) ABSTRACT

An anti-rotation system that prevents undesired rotation of an outer flange of a strap dispenser includes an anti-rotation element mounted to a shaft of the dispenser and the outer flange mounted to the anti-rotation element. The anti-rotation element and the outer flange have complementary mating surfaces such that when the shaft, on which the coil rotates, ceases rotation, the anti-rotation element, engaged with the outer flange, ceases rotation of the outer flange; thus, inertia of the coil cannot force the outer flange to rotate undesireably. A locking element abuts the outer flange to secure the flange to the anti-rotation element and a pin extends out from the shaft and inserts into a helical track in the locking element so that the pin rides in the helical track. The anti-rotation element also includes a through-bore for a fastener to secure the anti-rotation element to the shaft.

20 Claims, 7 Drawing Sheets

ANTI-ROTATION SYSTEM FOR STRAP DISPENSER OUTER FLANGE

CROSS-REFERENCE TO RELATED APPLICATION

This application claims the benefit of priority of Provisional U.S. Patent Application Serial No. 61/185,085, filed Jun. 8, 2009, entitled "ANTI-ROTATION SYSTEM FOR STRAP DISPENSER OUTER FLANGE".

BACKGROUND OF THE INVENTION

The present invention pertains to a strap dispenser. More particularly, the present invention pertains to an outer flange anti-rotation system for a strap dispenser for plastic or metal strap in coil form.

Coil dispensers are used as a source or supply of coil material for many strapping operations. Coil dispensers can be free-standing, supported on carts or mounted to strapping machines. The coiled material is mounted on the dispenser so as to rotate to pay out strap.

In many mounting configurations, dispensers have an outside flange, which is that flange that resides on the outside or accessible side of the dispenser. In some configurations, the outside flange remains inaccessible, but is that flange that is removed from the dispenser to replace the strap material coil. In such arrangements, the outer flange rotates with payout of the material. That is, as the coil rotates to payout strap (the coil is mounted on a shaft that rotates when strap is called for and stops—brakes—when strap is no longer called for), the outer flange rotates with the coil. However, when a brake is applied and the shaft stops, inertia may induce the coil and outer flange to continue to rotate.

Present flange-retaining arrangements use a nut or threaded element that is threaded onto a central shaft and snugged against the flange to prevent the flange from rotating. However, if the coil and the flange do in fact rotate relative to the shaft, the flange retaining nut can tighten or loosen and either over-tighten the nut or allow the flange to loosen depending upon which direction the coil rotates to payout strap.

One way in which the over-tightening or loosening of the nut (and flange) has been overcome is by attaching a rigid steel finger to the outer flange to lock into supports that are fixed to an inner flange. Another way is by passing a pin attached to the inner flange through the outer flange. While these configurations function acceptably, there are a limited number of angles at which the outer flange can be installed onto the dispenser.

Accordingly, there is a need for a dispenser outer flange anti-rotation system. Desirably, such a system is readily installed onto and removed from the dispenser to allow easy strap coil replacement. More desirably, such a system allows for installation of the flange onto the dispenser at any of a number of angular locations.

BRIEF SUMMARY OF THE INVENTION

An anti-rotation system for a dispenser that dispenses flexible material from a coil that rotates on a dispenser shaft includes an anti-rotation element fixedly mounted to the shaft, and an outer flange mounted to the anti-rotation element. The anti-rotation element and the outer flange have complementary mating surfaces engaged with one another such that when the shaft ceases rotation, the anti-rotation element, engaged with the outer flange, ceases rotation of the outer flange; thus, rotation of the coil cannot force the outer flange to rotate undesirably.

A locking element, to lock onto the shaft, abuts the outer flange to secure the outer flange to the anti-rotation element. A pin extends out from the shaft and inserts into a helical track in the locking element. The helical track opens into a radial recess so that the pin rides in the helical track and traverses into the radial recess to reside in the radial recess.

The anti-rotation element and the outer flange are engageable with one another at multiple angles relative to one another by their complementary mating surfaces. The mating surfaces of the anti-rotation element are a series of radially spaced-apart, longitudinally extending projections. The mating surfaces of the outer flange are a series of recesses adapted to accommodate the projections. Thus, the projections of the anti-rotation element and the recesses of the outer flange alternate and mate with one another. The series of spaced-apart projections and the series of recesses define a series of mating crenellations.

The anti-rotation element includes at least 12 projections and the outer flange includes at least 12 recesses. The anti-rotation element also includes a radially extending through-bore configured to accommodate a fastener for securing the anti-rotation element to the dispenser shaft. The through-bore extends through a peripheral wall of the anti-rotation element. The locking element includes a central bore for positioning on the shaft, the helical track and radial recess being contiguous with one another and with the bore. A portion of the helical track is present on either side of the radial recess.

A strap dispenser with an anti-rotation system for dispensing flexible material from a coil, includes the anti-rotation system described above, wherein the strap dispenser includes a shaft on which the coil rotates, an anti-rotation element fixedly mounted to the shaft, and an outer flange mounted to the anti-rotation element. The anti-rotation element and the outer flange having complementary mating surfaces engaged with one another such that, as discussed above, when the shaft ceases rotation, the anti-rotation element, engaged with the outer flange, ceases rotation of the outer flange of the strap dispenser, thus preventing undesired rotation of the flange by action of a rotating coil on the outer flange.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings and photographs, wherein.

DETAILED DESCRIPTION OF THE INVENTION

Figure 1:
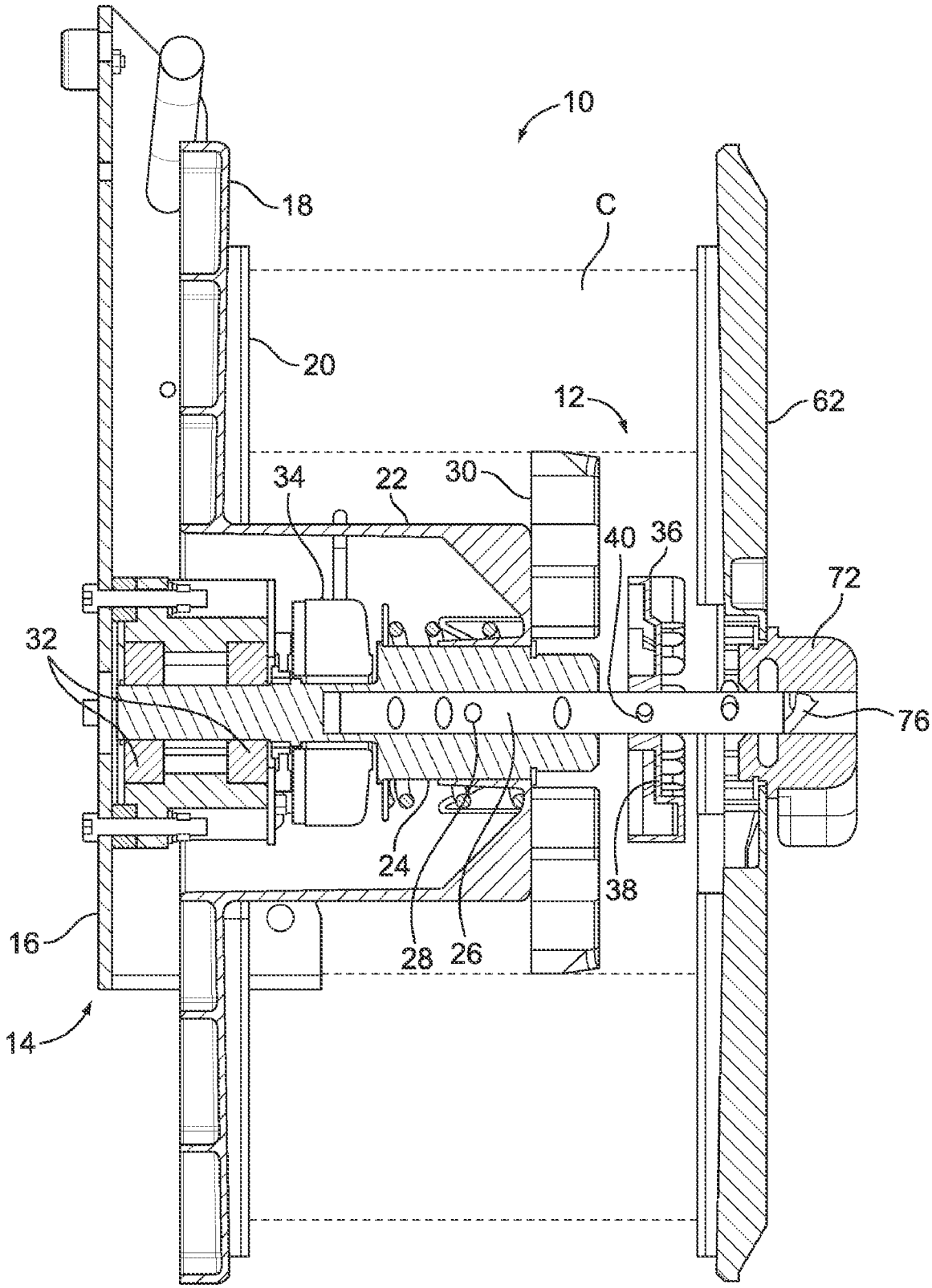
FIG. 1 is a cross-sectional view of a portion of a strap dispenser showing the inner hub, shaft, brake and inner and out flanges, and illustrating an outer flange anti-rotation system (in an exploded view for ease of illustration) embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a cross-section of a portion of a strap dispenser 10 with an outer flange anti-rotation system 12 embodying the principles of the present invention. The dispenser 10 is mounted to a frame 14, which in the illustrated embodiment is a door 16, that is stationary relative to the coil C (outline shown in phantom). Such a door-mounted dispenser 10 is better illustrated in Haberstroh, et al., U.S. Pat. No. 6,820,402, which patent is commonly assigned with the present application and is incorporated herein by reference.

The dispenser 10 includes an inner flange 18 that may have a foam pad 20 mounted to the inner flange 18 to permit applying a compressive force to the captured strap coil C. A central hub 22 is formed with the inner flange 18. In a present embodiment in which portions of the dispenser 10 are formed from molded plastics, the hub 22 and inner flange 18 can be formed as a single, unitary element.

An inner shaft 24 is mounted within the hub 22 and an outer shaft 26 is mounted to the inner shaft 24 in a keyed manner, as by pins 28 extending through and between the inner and outer shafts 24, 26. The inner and outer nomenclature is used to described the positional relationship relative to the inner direction of the machine and is not intended to imply any other relationship between the parts. The keyed arrangement permits the outer shaft 26 to be extended or refracted relative to the inner shaft 24, to, for example, accommodate wider or narrow strap coils C. Coils supports 30 can be mounted (e.g., fastened as by bolts) to the hub 22 to accommodate coils C having larger inner diameters. The coils supports 30, if used, engage the inner surface of the coil inner diameter to maintain the coil C concentric with the dispenser 10. The inner shaft 24 is mounted on bearings 32 to provide smooth rotation.

A brake 34 is mounted within the hub 22. The brake 34 is configured to stop rotation of the coil C when strap payout is no longer desired. Accordingly, the brake 34 is also stationary relative to the rotating hub 22, coil C, shafts 24, 26 and inner and outer flanges 18, 62 respectively.

As discussed above, in prior known mounting arrangements, the outer flange was set against the coil and a threaded nut (or knob) was tightened against the outer flange. However, in the prior mounting arrangement, when the brake was applied, the coil inertia could induce rotation of the flange even with the shaft stopped, which can loosen the nut (knob) and thus the flange.

Figure 7:
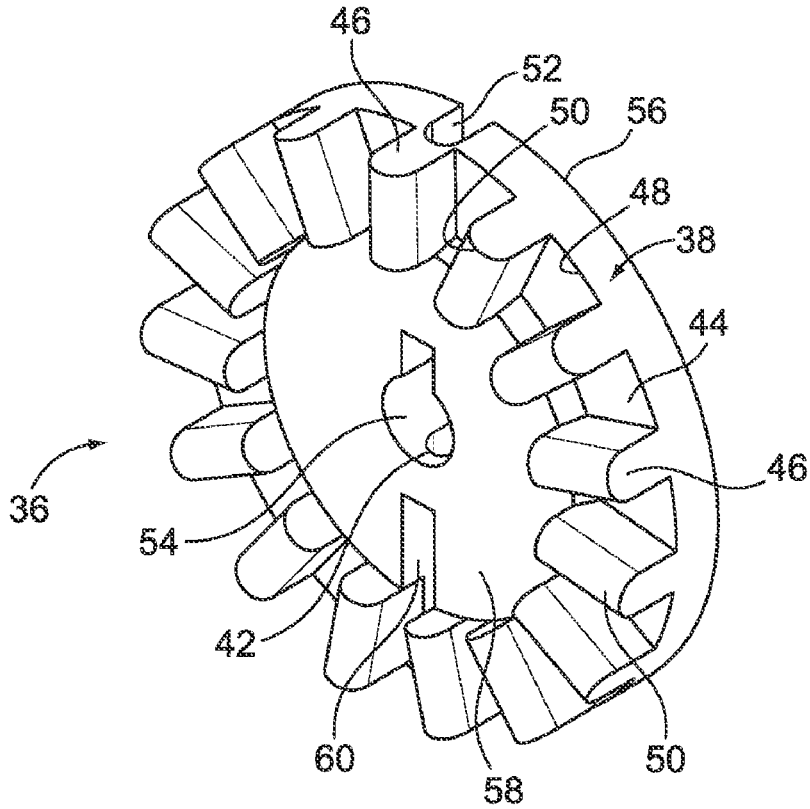
FIG. 7 is a perspective view of the anti-rotation disk.

The present outer flange anti-rotation system 12 includes an anti-rotation element 36 that is mounted to the outer shaft 26. In a present embodiment, the anti-rotation element 36 is formed as an anti-rotation disk 38, best seen in FIG. 7, and, referring again to FIG. 1, is keyed to the outer shaft 26 by a pin 40 that inserts through an opening 42 in the disk 38 and in the outer shaft 26 to tie or key the disk 38 and outer shaft 26.

Referring again briefly to FIG. 7, the disk 38 is formed having a planar portion 44 and a plurality of raised, radially extending projections 46 extending outwardly, longitudinally from a surface 48 of the disk 38. In a present embodiment, fifteen (15) projections 46 extend from the disk face 49. The projections 46 have a rounded top surface 50.

The disk 38 includes a radially extending pin recess or pocket 52 in the planar portion 44 that extends into a central bore 54 in the disk 38. The pin recess or pocket 52 is formed in a lower surface 56 of the planar portion 44. Opposite the pin recess 52, in an upper surface 58 of the planar portion 44, between projections 46, the disk 38 includes another pin recess or pocket 60 that also extends into the central bore 54. Essentially, the two inner and upper pin recesses or pockets 52, 60 and the opening 42 are all aligned with each other to provide a through-opening in the disk 38 from one side diametrically to the other. The two pin recesses or pockets 52, 60 and the opening 42 provide a keyway for keying or locking the disk 38 to the outer shaft 26, by, for example the pin 40. It will be appreciated that this configuration also lends itself well to molding (e.g., injection molding) the anti-rotation disk 38 and thus, being formed from a polymeric material.

Figure 2:
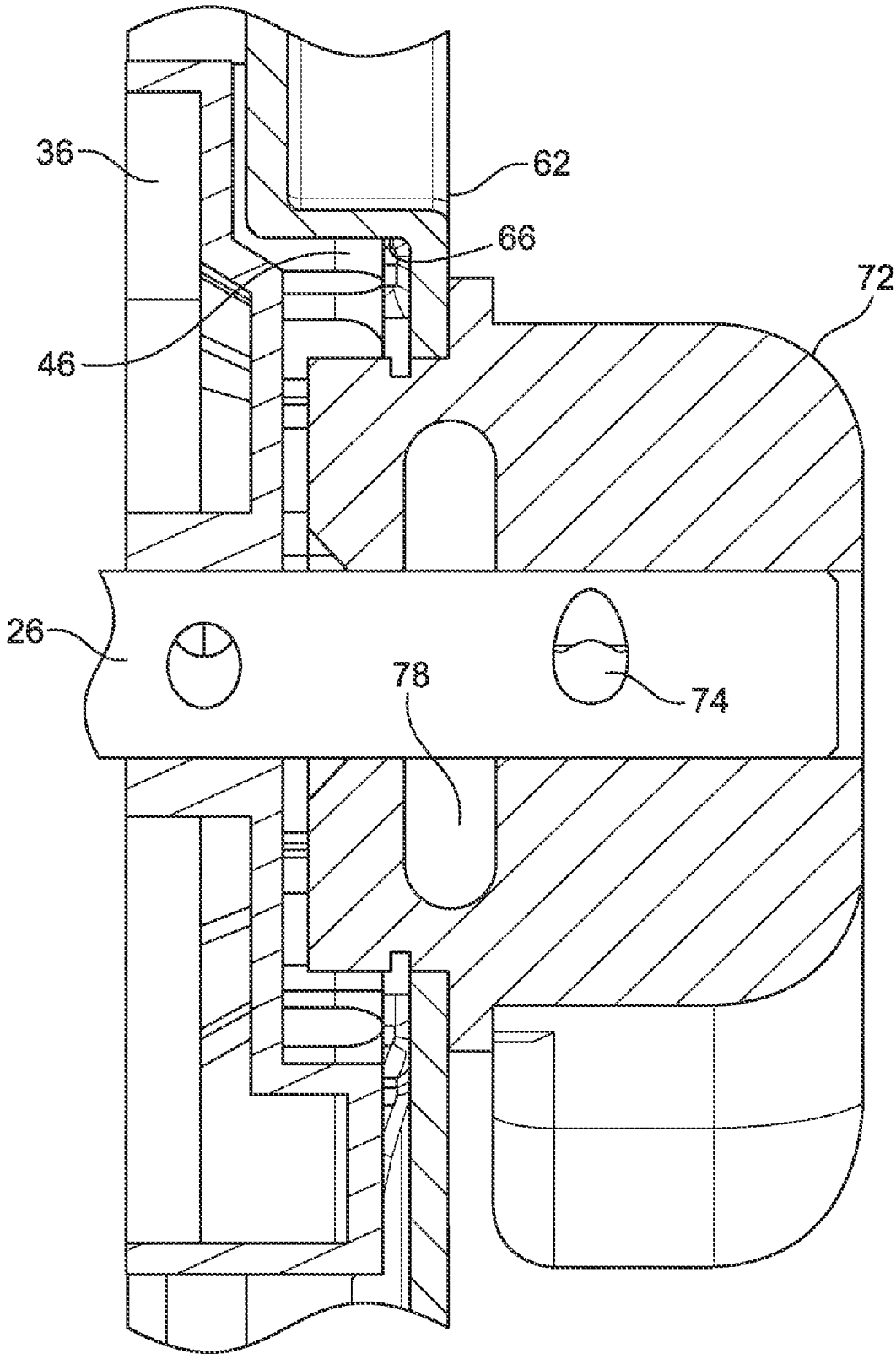
FIG. 2 is an enlarged partial sectional view showing the anti-rotation system in an assembled form with the anti-rotation disk engaged with the outer flange.
Figure 3:
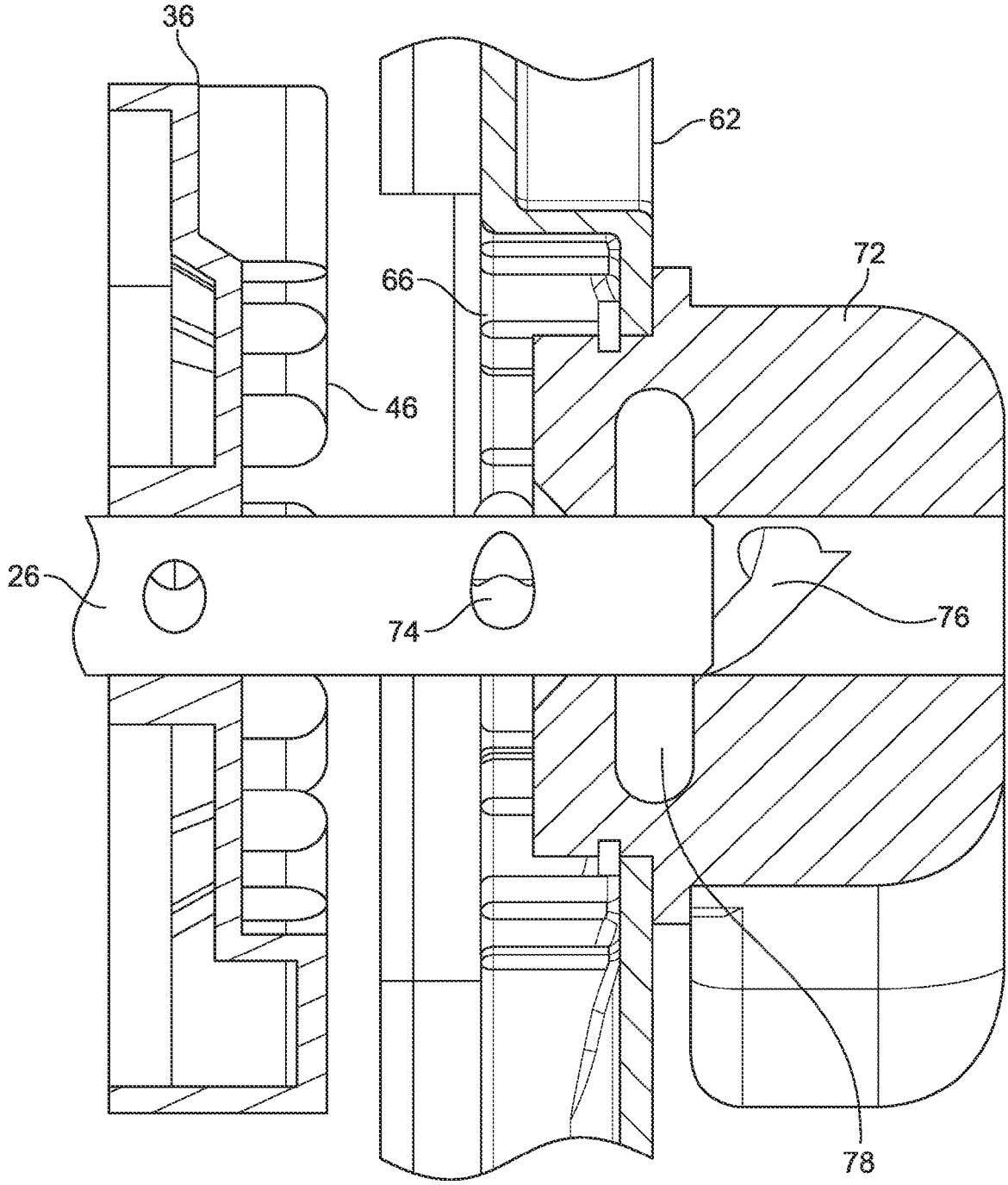
FIG. 3 is a view similar to FIG. 2 showing the anti-rotation disk separated from the flange.
Figure 4:
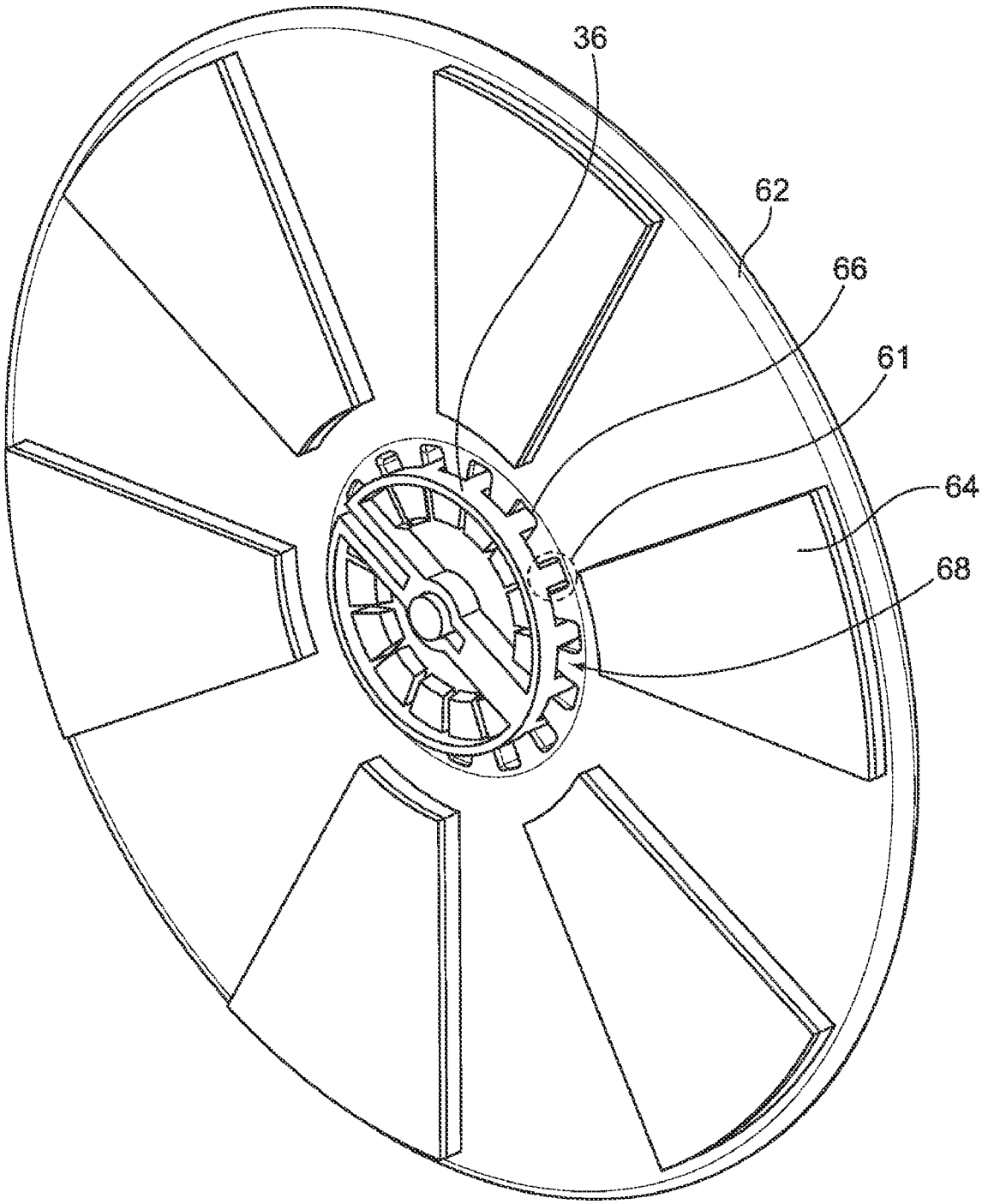
FIG. 4 is a perspective view of the anti-rotation disk engaged with the outer flange.
Figure 5:
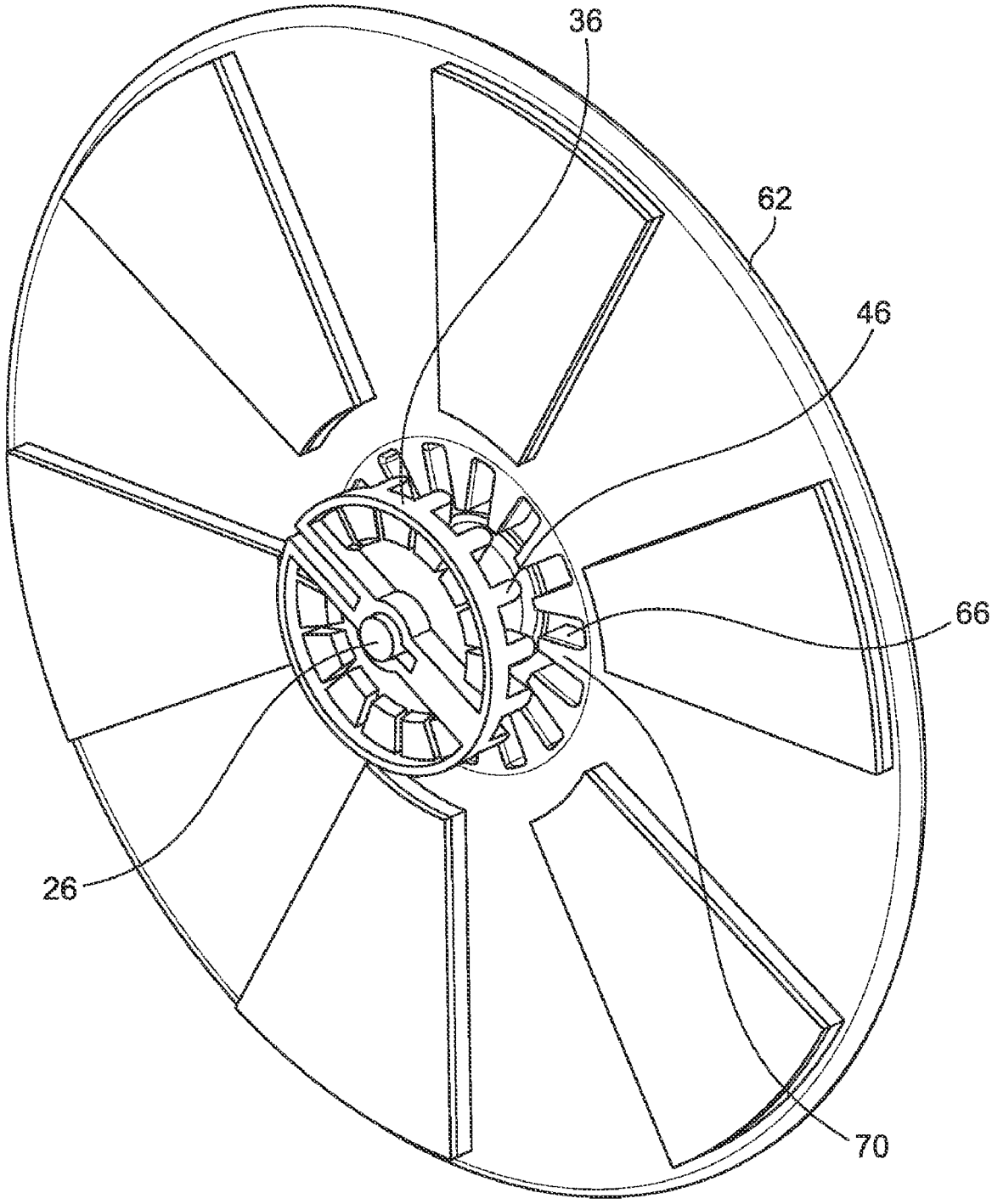
FIG. 5 is a view similar to FIG. 4 with the anti-rotation disk and outer flange separated from one another.
Figure 6:
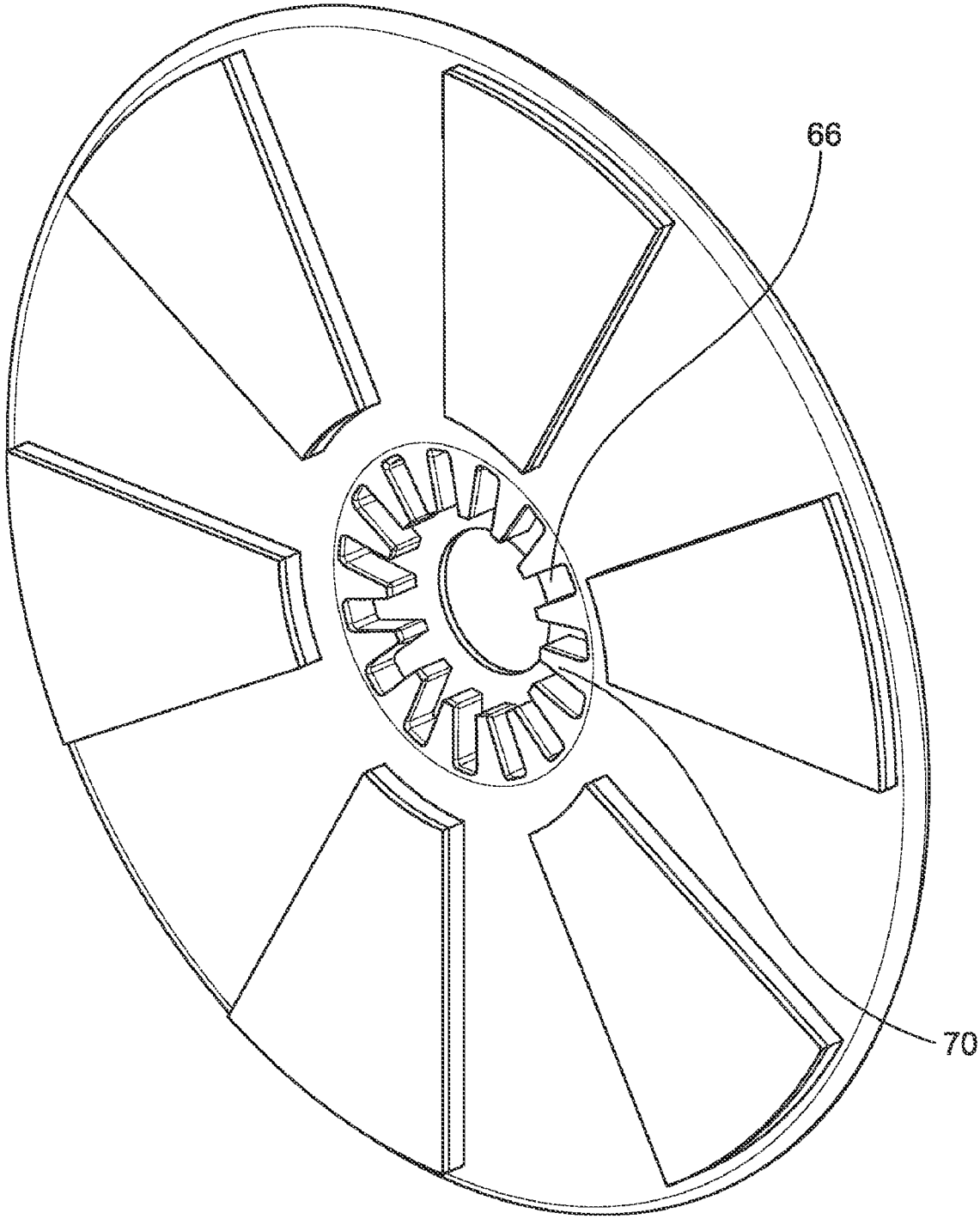
FIG. 6 is a perspective view of the inside surface of the outer flange.

Referring to FIGS. 4-7, the outer flange 62 is engaged and more particularly interlocked with the anti-rotation disk 38. The outer flange 62 (which, like the inner flange, may include a pad 64 for compressing the coil), includes complementary mating recesses 66 in a central portion 68. The mating recesses 66 are formed to receive the radially extending projections 46 from the anti-rotation disk 38. The mating recesses 66 are formed in a wall 70 such that when the anti-rotation disk 38 and the outer flange 62 are interlocked with one another, the wall 70 (in which the mating recesses 66 are formed) and the planar portion 44 abut or are adjacent one another (see the cross-section in FIG. 2). The interlocking projections 46 and mating recesses 66 essentially form complementary interlocking crenellations 61. This arrangement maintains the outer flange 62 rotationally "tied" to the anti-rotation disk 38 so that when the disk 38 is stopped, as by applying the brake 34 and stopping the shafts 24, 26, the outer flange 62 will likewise be stopped. It will also be appreciated that the configuration of the outer flange 62 lends itself well to molding (as by injection molding) and thus, being formed from a polymeric material.

In order to lock the outer flange 62 to the outer shaft 26 and anti-rotation disk 38, a locking element or knob 72 is configured to reside on and lock to the outer shaft 26. A pin 74 extends out from the outer shaft 26 and inserts into a helical track 76 in the knob 72. The helical track 76 opens into a radial recess 78 so that the pin 74 rides in the track 76 and traverses into the recess 78 to reside in the recess 78. This locks the pin 74 in the knob 72 which locks the knob 72 onto the outer shaft 26.

It will be appreciated that the outer flange anti-rotation system 12 is configured to lock the outer flange 62 to a portion of the dispenser 10 that rotates with free rotation of the coil C (during payout) but is stopped upon braking of the coil C. This prevents the inertia that may have built up in the rotating coil C from inducing rotation of the outer flange 62 when the outer shaft 26 is stopped, potentially loosening the outer flange 62 from the dispenser 10.

One of the benefits of the present anti-rotation system 12 is that the outer flange 62 can engage the anti-rotation disk 38 at any of a wide variety of angles. That is, because the disk 38 and mating surface 66 in the flange 62 have 15 mating elements, the flange 62 can mate with the disk 38 at 24 degree (360°/15) increments. Moreover, because of the rounded top surfaces 50 of the projections 46, event if the flange 62 is positioned with the projections 46 slightly off from the mating recesses 66, the rounded surface 50 will tend to rotate the flange 62 to an appropriate position.

Another benefit, of course, is that the outer flange 62 is secured to the shaft 26 and as such, even the inertia of the coil C will not induce rotation in the flange 62. That is, the flange 62 will not inadvertently loosen from the dispenser 10. And, because of this locking arrangement, strap payout can be either direction—that is, the coil C can rotate clockwise or counterclockwise without concern for loosening or over-tightening of the flange 62.

Figure 8:
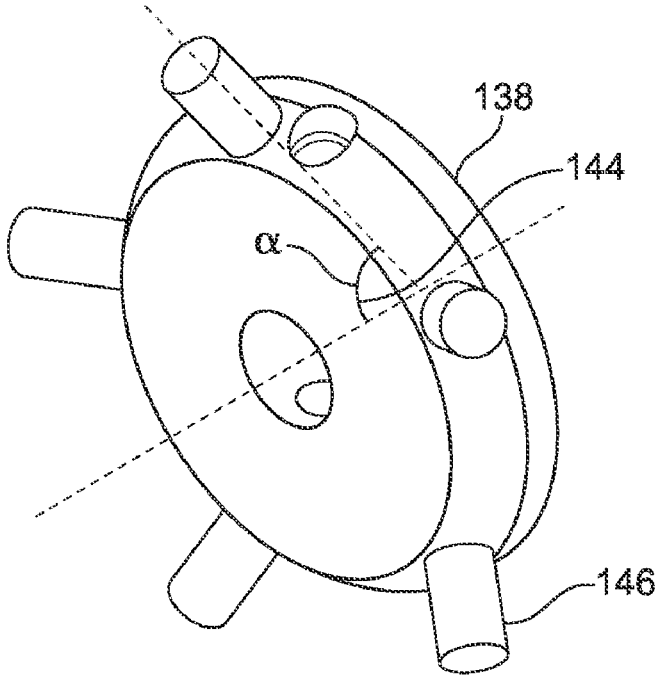
FIG. 8 is a perspective view of an alternate embodiment of the anti-rotation disk.

An alternate embodiment of the anti-rotation disk 138 is illustrated in FIG. 8 in which a central hub 144 has projections formed as rounded cylindrical pins or stubs 146 extending radially outwardly therefrom at an angle a relative to the longitudinal axis of the hub 144. This flared arrangement provides for good engagement of the disk 138 with the flange recesses 166. In this illustrated embodiment, there are five (5) outward projections (or stubs) 146 to engage the recesses 166. Again, the two mating components, the disk 138 and the flange 162, can engage each other at 24 degree increments.

It will be understood that a wide variety of configurations for the flange and anti-rotation disk are anticipated and are considered to be within the scope of the present invention.

All patents referred to herein, if any, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An anti-rotation system for a dispenser for dispensing flexible material from a coil, the dispenser having a shaft on which the coil rotates, comprising:

an anti-rotation element fixedly mounted to the shaft; and an outer flange having, on an inner surface thereof, a mating surface that includes a series of projections complementary to and interlocking with a surface of the anti-rotation element that includes a series of recesses adapted to accommodate the projections, the anti-rotation element and the outer flange complementary mating surfaces engaged with one another such that when the shaft ceases rotation, the anti-rotation element, engaged with the outer flange, ceases rotation of the outer flange.

2. The anti-rotation system in accordance with claim 1 including a locking element to lock onto the shaft, abutting the outer flange, to secure the outer flange to the anti-rotation element.

3. The anti-rotation system in accordance with claim 2 wherein a pin extends out from the shaft and inserts into a helical track in the locking element.

4. The anti-rotation system in accordance with claim 3 wherein the helical track opens into a radial recess so that the pin rides in the helical track and traverses into the radial recess to reside in the radial recess.

5. The anti-rotation system in accordance with claim 1 wherein the anti-rotation element and the outer flange are engageable with one another at multiple angles relative to one another.

6. The anti-rotation system in accordance with claim 1 wherein the anti-rotation element mating surfaces are a series of radially spaced-apart, longitudinally extending projections and wherein the outer flange mating surfaces are a series of recesses adapted to accommodate the projections, wherein the projections and the recesses alternate and mate with one another.

7. The anti-rotation system in accordance with claim 6 wherein the series of spaced apart projections and the series of recesses define a series of mating crenellations.

8. The anti-rotation system in accordance with claim 6 wherein the anti-rotation element includes at least 12 projections and the outer flange includes at least 12 recesses.

9. The anti-rotation system in accordance with claim 6 wherein the anti-rotation element includes a radially extending through-bore configured to accommodate a fastener for securing the anti-rotation element to the dispenser shaft.

10. The anti-rotation system in accordance with claim 9 wherein the through-bore extends through a peripheral wall of the anti-rotation element.

11. The anti-rotation system in accordance with claim 6 wherein the locking element includes a central bore for positioning on the shaft, the helical track and radial recess being contiguous with one another and with the bore.

12. The anti-rotation system in accordance with claim 11 wherein a portion of the helical track is present on either side of the radial recess.

13. A strap dispenser with an anti-rotation system for dispensing flexible material from a coil, the strap dispenser comprising:

a shaft on which the coil rotates;

an anti-rotation element fixedly mounted to the shaft; and an outer flange having, on an inner surface thereof, a mating surface that includes a series of projections complementary to and interlocking with a surface of the anti-rotation element that includes a series of recesses adapted to accommodate the projections, the anti-rotation element and the outer flange complementary mating surface engaged with one another such that when the shaft ceases rotation, the anti-rotation element, engaged with the outer flange, ceases rotation of the outer flange.

14. The strap dispenser in accordance with claim 13 including a locking element to lock onto the shaft, abutting the flange to and secure the outer flange to the anti-rotation element.

15. The strap dispenser in accordance with claim 14 wherein a pin extends out from the shaft and inserts into a helical track in the locking element.

16. The strap dispenser in accordance with claim 15 wherein the helical track opens into a radial recess so that the pin rides in the helical track and traverses into the radial recess to reside in the radial recess.

17. The strap dispenser in accordance with claim 16 wherein the anti-rotation system is configured to lock the outer flange to a portion of the dispenser that rotates with free rotation of the coil and is stopped upon braking of the coil.

18. The strap dispenser in accordance with claim 15 wherein the anti-rotation element mating surfaces are a series of radially spaced-apart, longitudinally extending projections and wherein the flange mating surfaces are a series of recesses adapted to accommodate the projections, wherein the projections and the recesses alternate and mate with one another.

19. The strap dispenser in accordance with claim 18 wherein the series of spaced apart projections and the series of recesses define a series of mating crenellations.

20. The strap dispenser in accordance with claim 13 wherein the anti-rotation element and the outer flange are engageable with one another at multiple angles relative to one another.

* * * * *